United States Patent [19]

Latterman et al.

[11] 4,010,361

[45] Mar. 1, 1977

[54] LIGHT DEFLECTION APPARATUS

[76] Inventors: Robert C. Latterman, 1720 E. LaDonna, Tempe, Ariz. 85283; Stuart G. Mirell, 407 W. Unversity Drive, Tempe, Ariz. 85281

[22] Filed: Mar. 3, 1975

[21] Appl. No.: 554,470

[52] U.S. Cl. ..... 240/10 R; 84/464; 240/2; 240/10.1; 353/1

[51] Int. Cl.[2] ..... A63J 17/00

[58] Field of Search ..... 240/10 R, 10.1, 2 L, 240/48; 84/464; 40/28.3, 130 L; 353/2, 1; 350/4

[56] References Cited

UNITED STATES PATENTS

| | | | |
|---|---|---|---|
| 2,411,804 | 11/1946 | Plebanek | 353/2 |
| 2,607,269 | 8/1952 | Elsaesser | 353/2 |
| 3,048,075 | 8/1962 | Wright | 353/2 |
| 3,139,604 | 6/1964 | Meiners et al. | 240/48 X |
| 3,318,187 | 5/1967 | Prohaska | 84/464 X |
| 3,473,428 | 10/1969 | Phillips | 84/464 |
| 3,473,429 | 10/1969 | Tandberg | 84/464 |
| 3,501,217 | 3/1970 | Bottani | 353/2 X |
| 3,590,681 | 7/1971 | Cross | 84/464 |
| 3,603,195 | 9/1971 | Williams | 84/464 |
| 3,892,478 | 7/1975 | Lampkin | 84/464 X |

*Primary Examiner*—Russell E. Adams, Jr.
*Attorney, Agent, or Firm*—H. Gordon Shields

[57] ABSTRACT

Light deflection apparatus is disclosed which uses a mirror to deflect a beam of light in response to an electromechanical transducer receiving an audio signal.

3 Claims, 8 Drawing Figures

LIGHT DEFLECTION APPARATUS

BACKGROUND OF THE INVENTION

1. Field of the Invention

This invention relates to light deflection apparatus, and, more particularly, to light deflecting apparatus which deflects a beam of light from a mirror in response to an audio signal and the deflected light traces a visual pattern in response to the audio signal.

2. Description of the Prior Art

There have been numerous prior art devices which utilize transducers to produce movement in a mirror or in a membrane in response to sound waves. The sound waves are generated by an electromechanical transducer of varying types which receive audio signals in the form of electrical current impulses. In some situations, a membrane is used to directly receive sound waves moving through an air mass, such as generated by a speaker cone.

For example, in the Plebanek patent, U.S. Pat. No. 2,411,804, a diaphragm is used to rotate a tray which includes a plurality of movable objects on the tray. Light projecting apparatus is used to direct light from various sources at the objects on the tray. Light reflected from the objects on the tray is directed against a screen and the light traces a visual pattern on the screen in response to sound waves from a speaker which causes diaphragms associated with each light source to vary the light directed against the objects on the tray.

In the Wright patent, U.S. Pat. No. 3,048,075, a flexibly supported container is used in conjunction with an electromechanical transducer to convert sound into light responsive patterns. The container is partially filled with a fluid which includes a multiplicity of freely movable particles of various shapes and the container is mechanically vibrated in response to the sound waves. The particles in the fluid move in response to the sound, and accordingly provide a varying color pattern in response to the sound.

An animated advertising display is disclosed in the Byrnes patent, U.S. Pat. No. 3,402,496. A flexible membrane or diaphragm is secured to a face plate and a permanent magnet and electric coil is located adjacent the diaphragm, with a permanent magnet affixed to the diaphragm. The diaphragm includes a plurality of slits extending radially outwardly from the center of the diaphragm, where the permanent magnet is secured. The movement of the permanent magnet in response to current through the coil results in vibration of the permanent magnet and in oscillation of the flexible strips of the diaphragm.

In still another embodiment, the Phillips patent, U.S. Pat. No. 3,473,428, an electrical transducer is connected to a sound system and a plurality of light reflecting elements are supported by the transducer. Movement of the transducer in response to the sound results in movement of the light reflecting elements. A light source is directed at the light deflecting elements and visual images are then reflected to a surface.

In the Williams patent, U.S. Pat. No. 3,603,195, a plurality of light deflecting elements are suspended from a diaphragm which extends across a speaker cone. The volume of air between the speaker cone and the diaphragm causes the diaphragm to vibrate in response to movemnt of the speaker cone in the generation of sound therefrom. A light source is directed at the mirrors on the diaphragm and the reflected light results in the projection of a multiplicity of patterns.

SUMMARY OF THE INVENTION

Apparatus is disclosed in which a light deflecting mirror is secured to a mass which is caused to move in response to movement of an elastic element secured to an electromechanical transducer. A source of highly collimated light, such as from a laser, is directed at the mirror and the light reflected from the mirror in response to movement of the mirror traces a visually varying pattern on a surface.

Among the objects of the present invention are the following:

To provide new and useful light deflecting apparatus;

To provide new and useful light deflecting apparatus in response to movement of an electromechanical transducer;

To provide new and useful light deflecting apparatus in response to movement of a mass secured to an elastic element; and To provide new and useful transducer apparatus for changing an electromechanical signal into a light pattern.

DESCRIPTION OF THE PREFERRED EMBODIMENT

Figure 1:
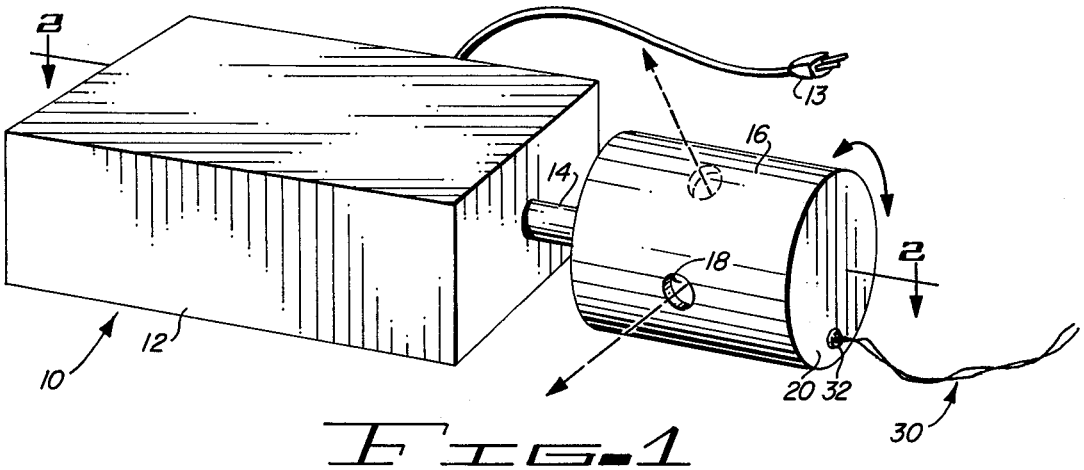
FIG. 1 is an isometric view of apparatus embodying the present invention.

FIG. 1 is a perspective view of light deflection apparatus 10 which embodies the present invention. The light deflection apparatus 10 includes a light source, 12, schematically represented by a box. The light source 12 includes a housing in which is disposed a laser. The laser is preferably a gas laser, operating in the red spectral range and which consumes a relatively low amount of electrical power. The laser operates on common 110 volts alternating current and a line cord 13 is shown extending from the light source 12 to provide the necessary electrical power.

A tube 14 extends from one end of the light source 12 to a canister 16. The canister includes a tube 14 and is rotatable along its longitudinal axis with the tube 14, which is aligned and coaxial with the longitudinal axis of the canister. The tube 14 is hollow and provides for the transmission of light from the laser within light source 12 to the canister 16.

The canister 16 is in the configuration of a cylinder having a pair of ends closing both ends of the cylinder, except for tube 14. A window 18 extends through the wall of the cylinder about centrally, or midway along, of the length of the cylinder. An end 20 of the canister 16 is shown in FIG. 1, and a pair of electrical conductors 30 is shown extending through a grommet 32 in the end 20. The electrical conductors 30 provide an electrical signal to a transducer within the canister, as will be explained in detail below. Since the canister 16 is rotatable about its longitudinal axis, the window 18 may be oriented in any desired location. The light deflected from the apparatus within the canister from the light source 12 is reflected outwardly through window 18 and on to any suitable or desired medium, such as a roof, a wall, a screen, or the like.

Figure 2:
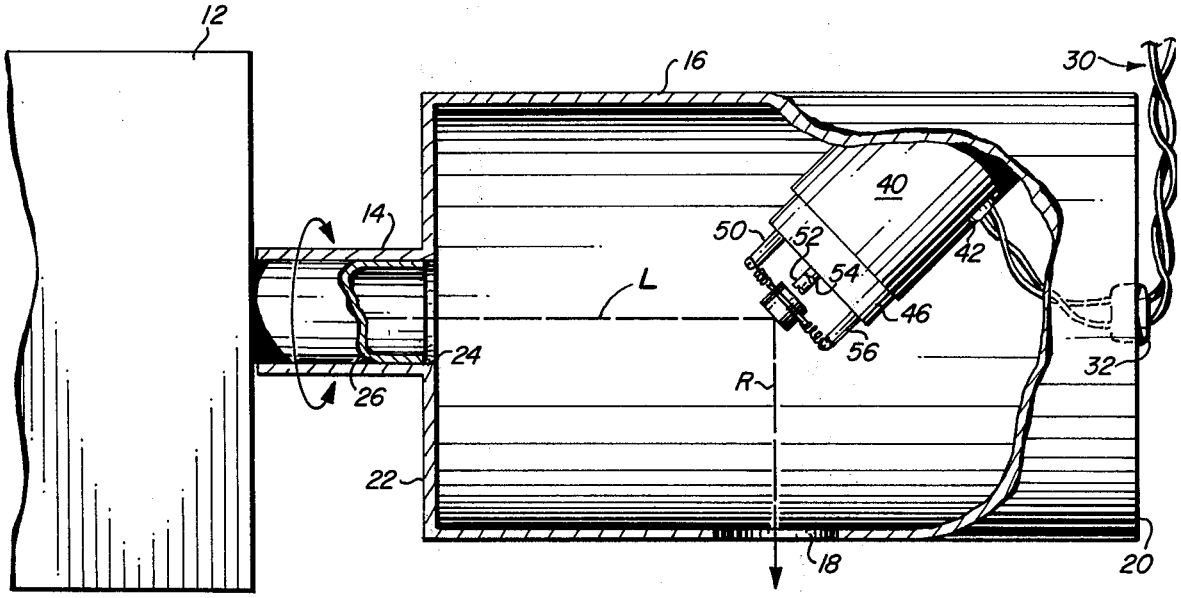
FIG. 2 is a view in partial section and partially broken away of the apparatus of FIG. 1 taken generally along line 2—2 of FIG. 1.

FIG. 2 is a view in partial section, and partially broken away, of the apparatus of FIG. 1 taken generally along line 2—2 of FIG. 1. The light source 12 is still schematically represented as a box 12. The tube 14 is shown in partial section to be a hollow cylindrical member secured to an end 22 of the canister 16. The tube 14 defines a circular aperture 24 in the end wall 22. The aperture 24 is located with respect to the longitudinal axis of the canister 16.

Within tube 14, and secured to the light source 12, is another tube 26, through which is transmitted the light from a laser within light source 12. With the interior tube 26 secured to the light source, and the exterior tube 14 secured to the canister, the two tubes comprise a conduit for the light from the light source into the interior of canister 16. The tubes, coaxially disposed with respect to each other, also provide mating surfaces for the rotation of canister 16 with respect to the light source 12. That is, the interior surface of tube 14 is able to rotate on the exterior surface of tube 26 to provide for relative motion between the light source and the canister without any loss of light between the two. The tube 26 extends to aperture 24, but does not extend into the canister.

Within the canister 16 is a transducer 40 which is disposed at about a 45° angle with respect to the longitudinal axis of the canister 16. The transducer is electrically connected exteriorally of the canister by a pair of conductors 30. The conductors 30 extend through a grommet 32 in end wall 20 of the canister 16, and through another grommet 42 on the side of transducer 40.

The transducer 40 comprises a magnetic transducer for translating electrical impulses or signals into magnetic pulses, substantially similar to the action of a speaker voice coil with respect to a speaker cone. The electrical signals are transmitted to the transducer through the conductors 30 and the transducer acts as an electromagnet with respect to the effect of the electrical impulses and the apparatus secured to the transducer.

A support element 46 is secured to the transducer 40 at one end thereof. The support element 46 vibrates or moves according to the electromagnetic signals which comprise the output of the transducer in response to the electrical signals on conductors 30.

Connected to the support element 46 are a plurality of posts 50, 52, 54, and 56. The posts are rigid and accordingly the movement of the support element 46 is transmitted through them in direct response to the movement of the support element and the transducers. A tension spring is connected to each of the posts for supporting a mass and a mirror secured to the mass. The mass and mirror are radially disposed in the center between the posts. The vibrations or movements induced in the support element by the transducer are accordingly transmitted by the posts which are connected to the support element and in turn the vibrations or movements are transmitted to the mass or weight and to the mirror which is secured thereto. The springs allow the mass or weight, with its mirror, to move and fluctuate so as to allow maximum movement of the mirror. Incident light from the light source 12, indicated by the letter "L" moves through the tubes 26 and 14 and strikes the mirror attached to the weight held by springs attached to the posts 50 . . . 53 which are in turn secured to the support element 46. Reflected light, denoted by the letter "R", is the light deflected by the mirror. The deflected light is reflected out of the canister 16 through the aperture or window 18.

Figure 3:
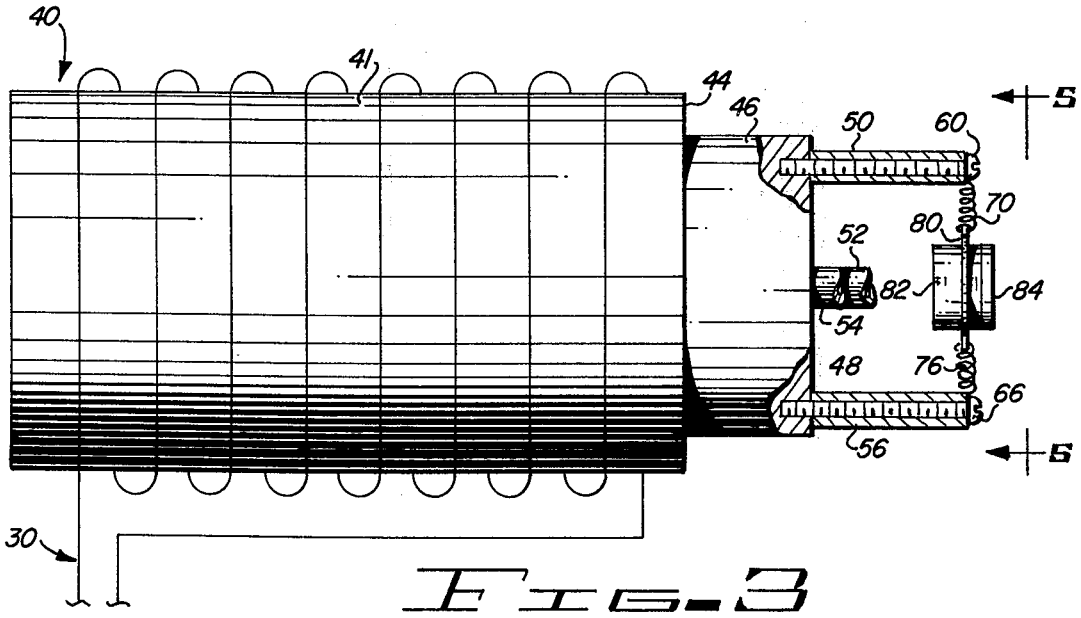
FIG. 3 is an enlarged side view of a portion of the apparatus of FIG. 2.

FIG. 3 is an enlarged side view of a portion of the apparatus of FIG. 2, in partial section, and in partial schematic representation.

The transducer 40 is schematically represented as a core 41 and a winding 30. The leads 30 illustrated in FIGS. 1 and 2 are a continuation of the winding. The support element moves or vibrates in response to the movement of the core 41 which in turn is in response to the electrical current flowing through conductors 30 about the periphery of the core 41. The core 41 comprises a coil form for the winding secured thereto. The core and winding are disposed in a permanent magnetic field, not shown. The movement of the core and winding is in response to the electrical signals from a speaker, or the like, and the interacting of the magnetic field produced thereby and the permanent magnetic field.

Two of the posts, post 50 and post 56, are shown in partial section in FIG. 3. The posts are secured to the support element 46 by appropriate fastening means, such as bolts or screws. A machine screw 60 and a machine screw 66 extend respectively through posts 50 and 56 and into the support element 46. From a front face 48 of the support element 46, four tapped bores extend into the support element 46 to receive the threaded portions of the screws to secure the posts to the support element.

Between the posts and the heads to the respective screws, springs are disposed so as to be held in place between the head of each screw and its post to secure the springs to the respective posts. A spring 70 is secured to post 50 by screw 60, and a spring 76 is secured to post 56 by screw 66. The springs are tension springs, and they are in turn secured to a collar 80 which is secured to a weight or mass 82. The springs and their posts comprise an elastic suspension for the mass 82. The weight or mass 82 is preferably a solid cylindrical mass which is disposed or held substantially equidistant from each of the posts by the respective springs. Secured to the front of the weight or mass 82 is a mirror 84. Incident light from the light source (see FIGS. 1 and 2) impinges upon the mirror 84 and is reflected therefrom.

As the support element or member 46 moves in response to movement of the transducer 40, the movement of the posts corresponds to the movement of the support element and core 41 because the posts are secured directly to the element and core and are relatively rigid. The movement of the support element and posts is transmitted through the tension spring suspension to the mass or weight 82. Due to the laws of physics, the weight or mass 82 moves in response to movement of the elastic element or member 46. That is, because of its inertia, mass 82 resists motion and accordingly stresses the elastic suspension through the springs. However, while the support element and the transducer core is restricted to linear movement, the weight or mass 82 is not restricted to linear movement only, but moves in three dimensions due to its elastic suspension. The stressing of the elastic suspension results in non-linear oscillations of the mass or weight. Mirror 84, secured to the weight or mass 82, similarly moves with the weight or mass. Thus the non-linear oscillations of the weight or mass result in non-linear patterns in the light reflected by the mirror. Both the weight and the mirror move rhythmically according to the electrical signals which comprise an electric current through conductors 30 of the transducer 40. Incident light striking the mirror 84 is thus deflected and the angle of reflection of the light changes with the oscillations of the weight and mirror. The reflections are directly in response to the electrical signal on conductors 30. If the electrical signals on conductors 30 are in response to music, the movement or fluctuation of the weight 82 and of the mirror 84 will be a direct response to the signals produced by the music. In turn, the pattern of the reflective light will be an indication of the type of music, its rhythm, etc. translated into linear movement of the transducer and the element, and into non-linear motion of the weight and mirror. The linear movement and resulting non-linear oscillations produce a dynamic situation with respect to the reflected light.

Figure 4:
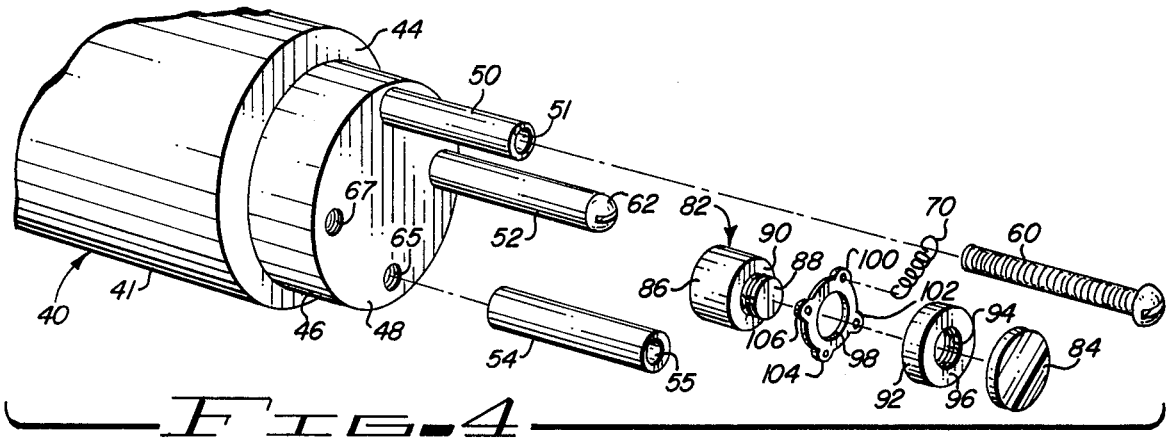
FIG. 4 is an oblique view, partially exploded, of the apparatus of FIG. 3.

FIG. 4 comprises an oblique view, partially exploded, of the apparatus of FIG. 3. The transducer 40 is shown with only the core 41 and without the conductors 30. The support element or member 46 is shown secured to the end 44 of the transducer core 41. Extending downwardly or inwardly as shown in FIG. 4, from the face 48 of the support element 46 are a plurality of tapped bores, of which only bores 64 and 66 are shown specifically in FIG. 4. The bores receive the screws, such as screw 60, which in turn support the posts and secures the posts to the support element.

Screw 60 is shown separated from post 50, which post is disposed on the face 48 of support element 46. The screw 60 extends through one end of spring 70 and through a bore 21 in post 50. Bore 51 extends longitudinally through the post 51, or along the longitudinal axis of the post 50, and receives the shank of the screw. Post 52 is shown with its screw 62 extending therethrough to secure the post to the support element 46. Post 54 is shown spaced apart from the elastic element and from its corresponding tapped bore or screw hole 65. Only the screw hole 67 is shown, and its post and machine screw are not shown in FIG. 4.

Between the four posts is suspended the weight or mass 82. The weight or mass 82 includes a body portion 86 which is generally cylindrical in configuration, and which includes a threaded plug 88 extending outwardly, or upwardly, with respect to a face 90. The plug 88 is centrally located with respect to the face 90, and extends coaxially with respect to the cylindrical body 86 of the weight or mass. A cap 92 is of the same general diametrical dimensions as in the cylindrical body 86. The cap includes a centrally disposed tapped bore 94 which has the same general interior dimensions as the exterior dimensions of the plug 88. The threads in the bore 94 matingly engage the exterior threads on the plug 88 to secure the cap to the cylindrical body 86.

The purpose for having the weight or mass 82 fabricated in two parts is to secure collar 80 thereto. That is, the collar 80 includes a central aperture 98 which is slightly larger than the exterior diameter of plug 88 and accordingly the collar 80 fits over the plug 88, with the plug received in the aperture 98. The collar is then held in place with respect to the cylindrical body 86 by the cap 92.

The collar 80 includes four ears 100, 102, 104, and 106 extending radially outwardly and spaced apart evenly equally on the periphery of the collar. Each of the ears includes a hole extending therethrough, to receive an end of the springs. One end of each spring is secured between the screws and the posts and the opposite end of each spring is received in an appropriate hole extending through the ears of the collar. Since the posts are spaced apart symmetrically with respect to the face 48 of the support element 46, and since the support element 46 is spaced symmetrically and appropriately secured to the end 44 of the transducer core or coil form 41, and the ears are similarly symmetrically disposed on the collar 80, the mass or weight 82 is held symmetrically spaced with respect to the posts.

The cylindrical body 86 and the cap 82 are of the same diameter so that the exterior surfaces of both portions of the weight or mass 82 are relatively smooth when the apparatus is assembled. Similarly, the collar 80 is of substantially the same diameter except for its ears so that it, too, except for the ears, allows a generally smooth configuration on the exterior periphery of the weight or mass, including the collar.

The cap 92 includes a front face 96 to which is secured the mirror 84. The mirror 84 is also of the same diameter as that of the weight or mass 82 and the collar 80, except for the ears of the collar. Accordingly, the mass, the collar, and the mirror are relatively uniform in their exterior or cylindrical configuration. That is, the weight or mass, with its cylindrical body and cap, and the collar disposed therebetween, and the mirror, together comprise a cylinder generally regular and uniform in the exterior cylindrical surface except for the ears of the collar. The uniformity is necessary or at least highly desirable if the mass or weight and the mirror is to move rhythmically with respect to the transducer. Accordingly, it is preferable that the weight be uniform and that the assembly of the weight, the collar, and the mirror be uniform and regular, and be symmetrically disposed with respect to the posts and to the transducer.

Figure 5:
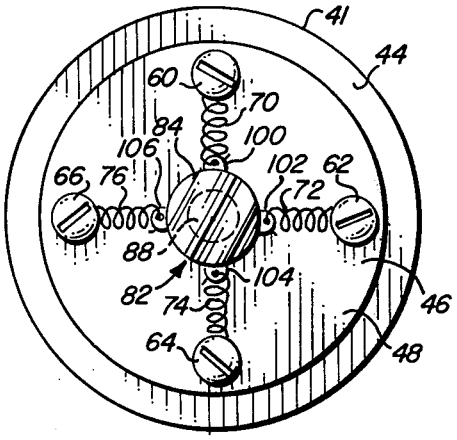
FIG. 5 is a view of the apparatus of FIG. 3 taken generally along line 5—5 of FIG. 3.

FIG. 5 is an end view of the apparatus of FIGS. 3 and 4 taken generally along line 5—5 of FIG. 3, rotated slightly clockwise from that of FIG. 3. Each of the screws 60, 62, 64, and 66, is shown extending outwardly from the face 48 of support element 46. In turn, the support element 46 is shown with respect to the end 44 of the transducer core or coil form 41.

Spring 70 extends between the screw 60 and ear 100, and spring 72 extends from screw 62 to ear 102. Spring 74 extends from screw 64 to ear 104, and spring 76 extends between screw 66 and ear 106. The ears, of course, are part of collar 80 (see FIGS. 3 and 4) which is secured to the weight or mass 82. Mirror 84 is secured to the weight or mass 82. As clearly indicated in FIG. 5, the mirror, as attached to the weight, is symmetrically disposed between the four screws, which in turn are symmetrically located with respect to the support element and to the transducer core. While tension springs are illustrated in the embodiment of FIGS. 1–5, obviously other types of tension elastic members could be used in place of the springs.

Figure 6:
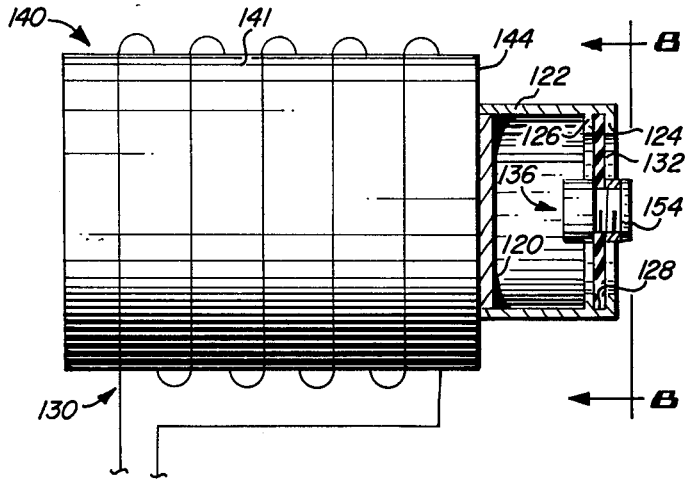
FIG. 6 is a side view of an alternate embodiment of the apparatus of FIG. 3.

FIG. 6 is a side view, in partial section, of an alternate embodiment of the apparatus of FIG. 3. In the embodiment of FIG. 6, a transducer 140 is shown which includes a core 141 and an electrical winding, comprising conductors 130 wound about the core. The core 141 includes a front end or face 144 to which is secured a flat disc 120. The disc 120 is symmetrically located with respect to the face 144 of the core 141, and it comprises a support element comparable to the support element 46 of the embodiment of FIGS. 1–5.

As in the embodiment of FIGS. 1–5, the core of the transducer comprises a coil form. A coil, comprising conductors 130, is wound about, and secured to, the core or coil form. The core and winding is in turn suspended in the field of a permanent magnet. The movement of the core and its winding is substantially as described above in conjunction with the embodiment of FIGS. 1–5.

A hollow cylinder 122 is secured to the flat disc or support element 120 at the outer periphery of the disc. Any appropriate means may be used to sealingly secure the disc and the hollow cylinder together. At the outer end of the hollow cylinder 122, distally located with respect to the disc 120, are a pair of radially inwardly extending flanges, outer flange 124 and inner flange 126. The flanges define a groove 128 between them. Disposed in the groove 128 is a circular elastic disc 132. The disc is secured in place within the groove 128 between the flanges 124 and 126. The disc is elastic, and thus able to flex or move.

The elastic disc or diaphragm 132 provides support for a mass or weight 136 which is sealingly secured to the disc at the center thereof. The mass or weight 136 has a mirror 154 secured to it. Light impinges upon the mirror and is reflected from the mirror. As the core 141 of the transducer moves in response to the interaction between the permanent magnetic field and the electromagnetic signals on conductor 130, the disc 120 and the hollow cylinder 122 secured thereto and to the face 144 of the transducer core move in relation to the movement of the transducer core.

The elastic disc 132 comprises a diaphragm which has the weight 136 secured in the center thereof. Due to the physical laws, such as inertia, as discussed above in conjunction with the embodiment of FIGS. 1–5, the movement of the diaphragm or disc 132 and its weight will be in response to the movement of the hollow cylinder affixed to the disc 120. However, the movement of the weight and of the diaphragm will be more than the linear movement to which the hollow cylinder and its discs are restricted since the elastic disc or diaphragm 132 is flexible enough to move or vibrate as required. This non-linear movement, or the vibrations of the flexible disc or diaphragm and the weight, will be translated into movement in response to the signals received by the transducer. Since the mirror 154 is affixed to the weight, it will move therewith and the light reflected therefrom from a fixed source will vary or move in accordance with the original signals received by the transducer on the conductors 130.

With the disc 120 sealingly secured to cylinder 122, and with the diaphragm or elastic disc 132 sealingly secured to both the cylinder 122 and the mass or weight 136, the cylinder is accordingly substantially closed or sealed. There is accordingly pneumatic dampening of the movement of the elastic disc or diaphragm. Axial modes or vibrations are suppressed by the pneumatic dampening, but at the same time non-axial modes or vibrations are enhanced. The diaphragm moves or warps in S type curves in an effort to maintain the same pressure and volume within the cylinder in response to movement of the cylinder and the transducer. While there is some compression within the cylinder, it is minimized. The inertia of the mass or weight resists movement and the warping of the diaphragm results. The non-axial modes or vibrations, which are the light deflective vibrations, are enhanced by the warping or movement of the diaphragm.

Figure 7:
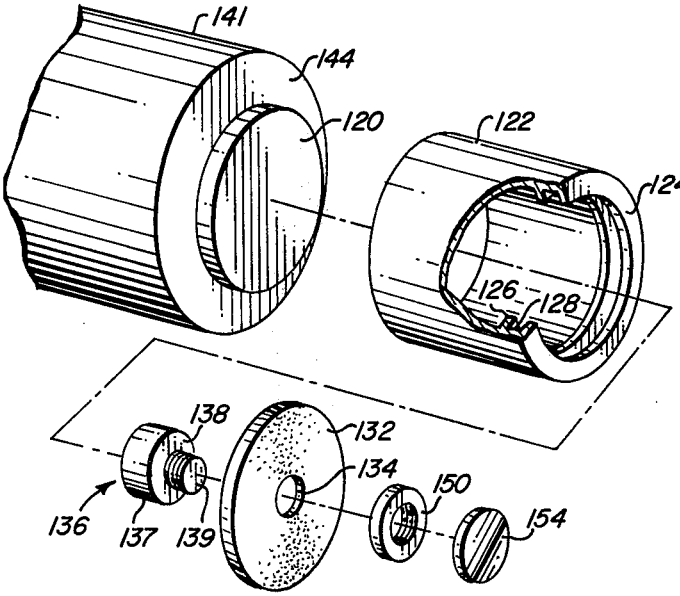
FIG. 7 is an oblique view, partially broken away and partially exploded, of the apparatus of FIG. 6.

FIG. 7 is a perspective view, partially exploded and in partial section, of the apparatus of FIG. 6. A portion of the transducer core 141 is shown with the solid disc 120 secured to the end or face 144 of the core. The hollow cylinder 122 is shown spaced apart from the disc 120 and the end or face 144 of the core.

The hollow cylinder 122 is shown partially broken away, and in partial section, to illustrate the flanges 124 and 126, both of which are radially inwardly extending with respect to the longitudinal axis of the cylinder 122. The flanges define a groove 128 between them. The flanges 124 and 126 are substantially the same size and provide support for the diaphragm or elastic disc 132 which is disposed within the groove 128.

The elastic disc or diaphragm 132 is circular in configuration, and is substantially the same diameter as the diameter of the groove 128. Moreover, the thickness of the diaphragm 132 is substantially the width of the groove 128 so that the disc is held relatively securely within the groove 128. The diaphragm is sealingly secured within the groove.

Centrally disposed with respect to the diaphragm 132 is a hole or aperture 134 which extends through the diaphragm. The hole or aperture 134 receives the weight 136, which is appropriately secured thereto. The hole or aperture 134 receives the weight 136, which is appropriately secured thereto.

The mass or weight 136 includes a substantially cylindrical solid body 137 which has a front face 138. Extending outwardly from the face 138 centrally and coaxially with respect to the body 137 is a threaded plug 139. The threaded plug 139 is of substantially the same diameter, or slightly less than the diameter, of the hole or aperture 134 in the diaphragm or elastic disc 132. The threaded plug 139 extends through the hole or aperture 134 and the face 138 of the body 137 is disposed against the elastic disc or diaphragm 132 adjacent the hole or aperture 134.

The body 137 and the diaphragm 132 are secured together by an annular cap or nut 150 which is threaded internally to threadedly engage the plug 139. The exterior diameter of the nut 150 is substantially the same diameter as the body 137. When the nut 150 is secured to the plug 139, the disc 132 is securely held to the body 137 thus unifying or securing together the mass or weight 136 and the diaphragm 132.

The mirror 154 is then secured to the annular nut 150. The mirror 154 is preferably of substantially the same diameter. With the mirror secured thus to the weight and to the diaphragm or elastic disc 132, movement imparted to the diaphragm or disc 132 by the core 141 of the transducer 140, as modified or varied by the relationship between the diaphragm 132 and the weight 136, is accordingly imparted to the mirror 154. The light impinging upon the mirror 154 from an appropriate light source, such as from light source 12 of FIGS. 1 and 2, is deflected by the mirror and the light thus reflected then traces a pattern which is related to the electromagnetic signals imparted to the transducer and to the angular change in the reflected light as the mirror moves.

Figure 8:
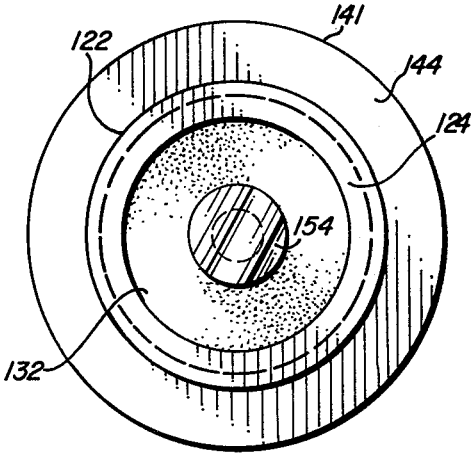
FIG. 8 is a view of the apparatus of FIG. 6 taken generally along line 8—8 of FIG. 6.

FIG. 8 is an end view of the apparatus of FIG. 6, taken generally along line 8—8 of FIG, 6. The transducer core 144 is shown with the hollow cylinder 122 secured to the face 144 of the transducer core. The front flange 124 of the hollow cylinder 122 is shown, and the elastic disc 132 is illustrated as secured to the hollow cylinder 122. Secured to and suspended from the center of the diaphragm or elastic disc 132 is mirror 154. Movement imparted to the elastic disc or diaphragm 132 accordingly results in movement of the mirror 154, which is secured to the weight and which in turn is secured to the elastic disc 132.

In both embodiments of the mirror suspension apparatus, illustrated in FIGS. 2, 3, 4, and 5, and in FIGS. 6, 7, and 8, the reflected light varies according to whatever input is transmitted to the transducer. For example, different types of music will result in various types or patterns of reflected light.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for deflecting light in response to electromagnetic signals, comprising, in combination:
   - movable transducer means for converting electrical signals into magnetic pulses, including
   - a winding for transmitting electrical signals, and
   - a core disposed in the winding and linearly movable in response to the electrical signals in the coil;
   - support means secured to the core and movable therewith, including a plurality of posts secured to the core and a plurality of tension springs, including a tension spring secured to each post;
   - a mass secured to the plurality of the posts of the support means by the tension springs and movable in a nonlinear manner in response to the movement of the core and the support means; and
   - a mirror secured to the mass and movable therewith to deflect light.

2. The apparatus of claim 1 in which the support means further includes a support element secured to the core and the posts are secured to the support element.

3. The apparatus of claim 1 in which the support means further includes a collar connected to the springs and to the mass for supporting the mass and the mirror.

* * * * *